US005616190A

United States Patent [19]

Legresy et al.

[11] Patent Number: 5,616,190

[45] Date of Patent: Apr. 1, 1997

[54] PROCESS FOR PRODUCING A THIN SHEET SUITABLE FOR MAKING UP CONSTITUENT ELEMENTS OF CANS

[75] Inventors: Jean-Marc Legresy, St. Egrève; Guy-Michel Raynaud, Issoire, both of France

[73] Assignee: Pechiney Rhenalu, Courbevoie, France

[21] Appl. No.: 397,067

[22] PCT Filed: Jul. 11, 1994

[86] PCT No.: PCT/FR94/00861

§ 371 Date: Apr. 24, 1995

§ 102(e) Date: Apr. 24, 1995

[87] PCT Pub. No.: WO95/02708

PCT Pub. Date: Jan. 26, 1995

[30] Foreign Application Priority Data

Jul. 16, 1993 [FR] France ..... 93 08987
Sep. 29, 1993 [FR] France ..... 93 11814

[51] Int. Cl.[6] ..... C22F 1/04

[52] U.S. Cl. ..... 148/551; 148/552; 148/695

[58] Field of Search ..... 148/551, 552, 148/567, 695, 700

[56] References Cited

U.S. PATENT DOCUMENTS 4,435,213 3/1984 Hildeman et al. ..... 148/567
5,186,235 2/1993 Ward ..... 148/552
5,306,359 4/1994 Eppeland et al. ..... 148/700
5,470,405 11/1995 Wyatt-Mair et al. ..... 148/551
5,531,840 7/1996 Uesugi et al. ..... 148/695

FOREIGN PATENT DOCUMENTS 1748899 7/1992 U.S.S.R. ..... 148/567

*Primary Examiner*—George Wyszomierski
*Attorney, Agent, or Firm*—Dennison, Meserole, Pollack & Scheiner

[57] ABSTRACT

The invention relates to a process for producing, by casting between rolls, an aluminum alloy sheet suitable for making up constituent elements of cans for food use, the aluminum alloy containing (by weight) between 1 and 4% of Mg and between 0 and 1.6% of Mn, the process being characterized in that said sheet is obtained by casting of said alloy in the liquid state between two rolls in the form of a strip having a thickness of at most 4 mm followed by at least one heat treatment at a temperature between 400° and 580° C. so that the sheet is at least partially recrystallized and cold-rolling to a final thickness of less than 0.3 mm.

The sheet obtained has a yield stress, a formability index and a resistance of the coating to delamination which are improved and make it suitable for application to can manufacture and, in particular, to can lids.

13 Claims, No Drawings

PROCESS FOR PRODUCING A THIN SHEET SUITABLE FOR MAKING UP CONSTITUENT ELEMENTS OF CANS

TECHNICAL SPHERE OF THE INVENTION

The present invention relates to a process for producing, by continuous casting between rolls, a thin sheet of aluminium alloy suitable for making up constituent elements or drinks cans or cans for use with foods.

It is known, for example, to produce lids intended to be combined impermeably with can bodies and thus to form packagings for foods in the liquid or solid state.

These lids are obtained by cutting from a sheet of aluminium alloy discs which may be equipped with opening devices fixed either by riveting or by adhesion.

In order to be able to carry out these mechanical operations and to withstand the stresses resulting from handling and from the pressures exerted inside the cans by certain foods such as carbonated drinks, said sheets have to have a suitable deformation capacity and an adequate yield stress.

Furthermore, as these sheets have to resist the corrosive effects of the atmosphere and of the products contained, it is essential to cover them with protective agents such as lacquers, for example, meaning that said sheets have to be adhesive toward said coatings.

STATE OF THE ART

The German document DE 3247698 (Alusuisse) discloses a process for producing a strip intended for making up can lids from aluminium alloy issuing from a continuous casting machine, characterised in that an alloy containing, by weight, 0.15 to 0.50% of Si, 0.3 to 0.8% of Fc, 0.05 to 0.25% of Cu, 0.5 to 1% of Mn, 2.5 to 3.5% of Mg and up to 0.20% of Ti is cast between two cooled casting rolls forming a casting gap of 5 to 10 mm and in that the resultant strip is cold-rolled to a final thickness of 0.4 to 0.2 mm.

According to this process, to achieve a yield stress of 321 MPa and an elongation of 7.7%, it is necessary, after rolling of the cast strip to a thickness of 1.9 mm, to carry out intermediate annealing involving heating the strip to 380° C. and keeping it at this temperature for 2 hours, then also carrying out final softening annealing by heating to 205° for 8 minutes prior to lacquering.

Therefore, in addition to the energy required to pass from a thickness e1=6.5 mm to a thickness e2=0.3 mm, according to the example, this reduction corresponding to a rolling ratio of (e1−e2)/e1×100=95.4%, this process also involves two heating operations at two different stages of rolling.

The document JP 04276047 (Sky Aluminium) describes a process for obtaining hard plates of aluminium alloy with a view to making up can lids, the process involving casting in a thin strip to a thickness of less than 15 mm at a cooling rate higher than 50° C./sec; the plate obtained is subjected immediately or after cold-rolling to a first intermediate annealing treatment, to cold-rolling with a reduction ratio of 30 to 85%, to the second intermediate annealing treatment and finally to final cold-rolling with a reduction ratio higher than 30%, this final cold-rolling optionally being followed by a final annealing treatment.

The alloy has the following composition:
Mg: 1.2 to 3%, Cu: 0.05 to 0.5%, Mn: 0.5 to 2%, Fe: 0.1 to 0.7%, Si: 0.1 to 0.5%, the remainder being Al.

A 6 mm thick plate having a yield stress at 45° to the direction of rolling of 305 to 310 N/mm$^2$ was obtained by this process.

The document EP 99739 (Continental) describes a process for obtaining an aluminium alloy strip suitable for drawing and ironing, for example with a view to obtaining cans. It involves the continuous casting of a strip having a thickness of less 2.54 cm, preferably between 6 and 12 mm, heating to 510° to 620° followed by cold-rolling with reduction in thickness by at least 25%, annealing, a second cold-rolling treatment with reduction of thickness by at least 10%, recrystallization heating and final cold-rolling.

12.1 mm thick strips of different compositions were obtained and treated by the described process; the final products obtained having the following characteristics (table XIX)
Yield Stress: 280 to 294 MPa
Tensile Strength: 291 to 308 MPa
Elongation: 2.2 to 2.5%

The document U.S. Pat. No. 4,411,707 (Coors) describes a process for obtaining strips suitable for the production of lids. It involves the continuous casting of a strip having a thickness of between 6 and 7 mm, this strip undergoing a reduction of at most 25% during solidification, then cold-rolling with a reduction of at least 60%, annealing at 440° to 483° C., cold-rolling by at least 80% to the final thickness.

The tensile strength obtained is 272 MPa, the yield stress 245 MPa and the elongation 4.1%.

It can be sen that all these processes employing varied alloy compositions involve at least one intermediate annealing treatment during cold-rolling, complicating implementation and increasing the cost.

AIM OF THE INVENTION

The aim of the invention is, with at least equal properties, to reduce the rolling ratio and to eliminate the intermediate annealing stages during cold-rolling so as to simplify the process and make it more economical.

SUBJECT OF THE INVENTION

The invention relates to a process for producing an aluminium alloy sheet intended for can manufacture composed of, by weight, between 1 and 4% of Mg, between 0 and 1.6% of Mn, remainder Al with its inevitable impurities and optionally additions of Cu and/or Cr, characterised in that said sheet is obtained by casting said alloy in the liquid state between two rolls in the form of a strip having a thickness at most equal to 4 mm, followed by at least one heat treatment at a temperature of between 400° and 580° C. so that the sheet is at least partially recrystallized, cold-rolling to a final thickness of less than 0.3 mm and optionally a coating operation.

The invention accordingly relates to a process which is firstly characterised by the casting of a strip between two rolls to a thickness less than or equal to 4 mm so that, to attain the thickness of a can lid to be produced, the rolling ratio is less than 95%; this avoids the need for intermediate annealing treatments between the rolling passes, this being the case once the thickness is greater than 4 mm, as seen above.

This invention is made possible by the use of the above-mentioned specific concentration ranges of the various elements of the alloy constituting the sheet; it allows improved properties, in particular enhanced mechanical characteristics, to be obtained.

Furthermore, it a thickness of 4 mm is exceeded, excessively high plastic anisotropy is obtained, leading to dimensional irregularities during production of the lid; in particular, the developed edge of the lid which will be crimped cannot respond to the performance specification and leads to waste.

Furthermore, casting to a thickness of less than 4 mm is favourable with regard to the quality of the strip, in particular with regard to the segregations which are greatly reduced if not absent, leading to improved formability and the obtaining of productivity in the region of its optimum.

However, it is not worth casting to a thickness of less than 1 mm because the cold working of the strip due to rolling is found to be inadequate and the mechanical strength of the strip becomes too weak for an application to lids.

A further characteristic of the invention is the obtaining of a partially (for example more than about 50%) or totally recrystallized structure after heat treatment between 400° and 580° C. of the strip issuing from the casting operation. This recrystallization of the metal is necessary for obtaining an alloy having excellent formability.

This operation may be carried out intermittently on the wound strip or during passage either on the strip continuously leaving the casting machine or on a previously wound strip after the casting operation. The duration of the heat treatment and the temperature depend on the rate at which the temperature rises. If an intermittent treatment is carried out, the heating rate is generally between 20° and 200° C./h. On the other hand, during passage, the heating rate is at least 3000° C./h. The treatment during passage also affords particular advantages for alloys containing less than about 0.75% of Mn. In fact, it leads to recrystallization with fine isotropic grains having dimensions smaller than 40 micrometers whereas intermediate annealing yields grains having dimensions of between 200 and 50 micrometers; this improves the formability of the sheet.

The treatment during passage is preferably carried out by heating in an induction furnace or in a hot air circulating furnace but any other method of treatment during passage of a strip may be considered.

However, the best results are obtained if this treatment during passage is followed by an intermittent treatment on a coil under the aforementioned conditions.

On the other hand, with alloys containing more than 0.75% of Mn, it is generally sufficient to carry out intermittent treatment on a coil in preference to a treatment during passage (at the casting outlet or on a coil).

After heat treatment, the strip is cold-rolled to the final thickness and the sheet obtained may be covered with a plastics material intended to protect it from the environment. This may be, for example, lacquering on the two faces with a lacquer which is then dried by heating to a temperature of between 200° and 280° C.

To obtain lids having suitable mechanical and formability characteristics, it is necessary for the process to be applied to a well-defined range of alloys.

These alloys have to contain between 1.0 and 4% of magnesium by weight because, beyond the maximum claimed, segregations which impair the formability may occur; on the other hand, a content of less than 1% leads to inadequate mechanical strength.

This magnesium is preferably combined with manganese in a proportion by weight of up to 1.6%. A content higher than the maximum value prevents suitable recrystallization during annealing and leads to the appearance of large grains which are detrimental to the mechanical properties.

However, it is particularly advantageous to have a simultaneous presence of magnesium and manganese satisfying the condition: (3 Mn %+2 Mg %) greater than or equal to 6% and less than or equal to 9% in order to obtain the best compromise between mechanical strength and formability.

The magnesium content is preferably less than 3.2% but the best results are obtained with an Mg content of less than 2.0%; in fact, the risks of segregation during casting, associated with the high Mg contents, are thus reduced.

The presence of Mn allows the Mg content to be limited and therefore the risk of segregation to be reduced; it is advantageously higher than about 0.4%.

Furthermore, the addition of a small quantity of copper of less than or equal to 0.4% and preferably less than 0.2% and/or the addition of chromium to about 0.2% allow the mechanical strength of the alloy to be improved. The content of these elements is limited since, in an excessively great quantity, they limit the ductility of the metal and therefore its formability.

Silicon and iron are mainly impurities whose presence depends on the quality of the aluminium used.

The silicon is preferably less than 0.3% or preferably less than 0.2% and the iron less than 0.5% or preferably less then 0.3%.

In fact, after casting or after heat treatment, the silicon leads, due to ageing, to the formation of intermetallic precipitates of $Mg_2Si$ which limit the formability of the alloy.

With regard to the iron, it gives rise to the formation of eutectic precipitates during casting and therefore of segregations which are also detrimental to the ductility.

EMBODIMENTS

The invention will be clarified by the following non-limiting embodiments.

Three types of alloy, A, B and C were used, having the following composition by weight:

| Alloy | Mg % | Mn % | Fe % | Si % | Cu % |
|---|---|---|---|---|---|
| A | 3.20 | 0.40 | 0.20 | 0.05 | 0.20 |
| B | 2.50 | 0.75 | 0.20 | 0.05 | 0.20 |
| C | 1.50 | 1.40 | 0.19 | 0.05 | 0.20 |

These alloys were subjected, during their preparation, to a refining treatment by addition of a titanium and boron containing aluminium alloy of the AT5B type introduced into the molten metal either directly in the preparation furnace or by progressive fusion of a wire upstream of the furnace.

Said alloys were cast between two rolls in the form of strips having a thickness of 2.8 mm at a speed of 3 m/min. These strips were subjected to heat treatments of three types:

I) Annealing during passage of the strip issuing from the casting machine in a furnace into which hot air is blown so that the strip is brought to 440° C. in the case of alloys A and B and 500° in the case of alloy C and is kept at this temperature for 30 seconds. The strip is then cooled to 300° C. and wound.

II) Intermittent annealing of the wound strip in a furnace where the metal is subjected to heating at 440° C. in the case of alloys A and B and 500° C. in the case of alloy C and maintenance of this temperature for 10 hours.

III) Annealing I is followed by annealing II.

The annealed strip is then subjected to 6 rolling passes without intermediate annealing to bring it into the form of a strip having a final thickness of 270 micrometers.

Said sheet is then degreased, subjected to a chemical conversion treatment and is then lacquered on both faces.

The following measurements were then taken from the sheet obtained:

Yield Stress: R 0.2% measured after annealing of the lacquers and in the longitudinal direction.

Ericksen formability index according to French standard NF A03-652.

Delamination of the lacquer (measurement taken after incision of the metal and pasteurization of the sheet at 75° C. for 30 minutes in demineralised water).

The results obtained, which refer to the alloys A, B or C heat treated according to I, II or III, appear in the following table:

| Reference | Yield Stress R 0.2% (MPa) | Ericksen Index (mm) | Delamination of the Lacquer (mm) |
|---|---|---|---|
| AI | 330 | 4.2 | 0.5 |
| AII | 325 | 4.5 | 0.4 |
| AIII | 328 | 4.9 | 0.4 |
| BI | 321 | 4.3 | 0.5 |
| BIII | 331 | 5.0 | 0.4 |
| CII | 338 | 5.0 | 0.4 |

Knowing that the characteristics required for obtaining suitable lids are a yield stress higher than 320 MPa, an Ericksen index higher than 4 and delamination of the lacquer of less than 0.6 mm, it is found that the objectives are achieved by the process according to the invention, in particular in the case where a heat treatment of type II or III is carried out.

It can be seen that the best results are obtained with BIII and CII, corresponding to respective heat treatments on the one hand during passage on the strip issuing from the casting operation followed by an intermittent treatment, on the other hand intermittently.

What is claimed is:

1. A process for producing an aluminum alloy sheet suitable for can manufacture comprising the steps of:

casting an alloy consisting essentially of, by weight, 1 to 4% Mg, 0 to 1.6% Mn, optionally Cu, optionally Cr, and remainder, Al and impurities, between two rolls to form a strip having a thickness of no more than 4 mm, performing at least one heat treatment on the strip as cast, at a temperature of 400° to 580° C. to effect at least partial recrystallization, and cold rolling the at least partially recrystallized strip to a final thickness of less than 0.3 mm.

2. Process according to claim 1, wherein 6%≦3 Mn %+2 Mg % ≦9%.

3. Process according to claim 1, wherein Mg<3.2%.

4. Process according to claim 3, wherein Mg<2.8%.

5. Process according to claim 1, wherein Mn is higher than about 0.4%.

6. Process according to claim 1, wherein said alloy contains less than 0.4% by weight of copper.

7. Process according to claim 6, wherein the alloy contains less than 0.2% by weight of chromium.

8. Process according to claim 1, wherein the heat treatment is carried out batch-wise on the strip wound in the form of a coil which is heated to the heat treatment temperature at a rate of between 20° and 200° C./h.

9. Process according to claim 8, wherein said alloy contains more than about 0.75% Mn.

10. Process according to claim 8, wherein the heat treatment is carried out in an in-line furnace prior to said batch-wise treatment.

11. Process according to claim 10, wherein said alloy contains less than about 0.75% Mn.

12. Process according to claim 1, wherein the heat treatment is carried out during passage of the strip through an in-line furnace with a heating rate to the heat treatment temperature higher than 3000° C./h.

13. Process according to claim 12, wherein the heat treatment is carried out in a batch-wise manner after said passage.

* * * * *